US005586943A

United States Patent [19]

Clay

[11] Patent Number: 5,586,943

[45] Date of Patent: Dec. 24, 1996

[54] GOLF TRAINING DEVICE

[76] Inventor: Hailie S. Clay, P.O. Box 326, La Honda, Calif. 94020

[21] Appl. No.: 590,616

[22] Filed: Jan. 24, 1996

Related U.S. Application Data

[63] Continuation of Ser. No. 340,250, Nov. 16, 1994, abandoned, which is a continuation-in-part of Ser. No. 134,419, Oct. 8, 1993, abandoned.

[51] Int. Cl.[6] ..... A63B 69/36

[52] U.S. Cl. ..... 473/214; 473/276; 128/182

[58] Field of Search ..... 473/207–217, 473/266, 272, 274–277; 128/774, 781, 782

[56] References Cited

U.S. PATENT DOCUMENTS 4,660,829 4/1987 Whiteneir ..... 273/187.2

5,086,785 2/1992 Gentile et al. ..... 128/782

5,316,017 5/1994 Edwards et al. ..... 128/782

FOREIGN PATENT DOCUMENTS 191555 8/1986 European Pat. Off. ..... 128/782

*Primary Examiner*—Mark S. Graham

*Attorney, Agent, or Firm*—Flehr, Hohbach, Test, Albritton & Herbert

[57] ABSTRACT

A training device mountable to an arm of an athlete for developing a proper arm swing. The training device includes a support body mountable to the arm of the athlete, a sensor assembly carried by the support body for detecting displacement of the arm in two directions of movement with one direction of movement being rotation about the longitudinal axis of the arm and the other direction of movement being bending of the arm. A signal actuator coupled to the sensor assembly produces a detectable signal when the sensor assembly detects displacement of the arm in at least one of the two directions of movement.

18 Claims, 5 Drawing Sheets

GOLF TRAINING DEVICE

CROSS REFERENCE TO RELATED APPLICATIONS

This is a continuation of application Ser. No. 08/340,250 filed Nov. 16, 1994 abandoned, which is a continuation-in-part of application U.S. Ser. No. 08/134,419, filed Oct. 8, 1993, abandoned. The disclosure of the above-mentioned application is incorporated herein by reference.

BRIEF DESCRIPTION OF THE INVENTION

This invention relates in general to a golf training device. More particularly, the invention relates to a device for developing and perfecting a proper golf swing.

BACKGROUND OF THE INVENTION

An important element of the proper golf swing is the position of the arm during the swing. The swing should be controlled by the shoulders, with the arms preferably being held in a substantially straight position during the backswing, downswing and follow through after the ball has been hit. The arm must also be twisted or rotated to the appropriate angle relative to the normal, resting position. Maintaining the proper arm position during the golf swing maximizes the force of acceleration imparted on the ball by the face of the golf club. When the athlete improperly bends or rotates his arm during the swing, a transverse motion is produced which must be overcome during the remainder of the swing, reducing the force of acceleration exerted on the ball. Retaining the arm in the proper position throughout the swing is generally desirable in golf as well as other sports such as tennis, racquet ball, etc.

Various devices have been used to assist the athlete in improving their swing by maintaining the desired arm position during the entire swing. U.S. Pat. No. 5,048,837 discloses training devices which manually restricts movement of the arm during part or all of the swing. The disclosed device holds the arm in a straight position during the swing when the device is worn. However, such a device may interfere with the athlete's movement and the athlete may return to the undesired arm position once the device is removed from the arm. U.S. Pat. Nos. 2,809,042 and 3,419,276 disclose devices which provide the athlete with a signal when the athlete improperly bents his arm at the elbow during the swing. U.S. Pat. Nos. 4,660,829, 5,108,103 and 5,324,038 disclose devices for developing the proper wrist position relative to the rest of the arm during the swing. An athlete may use the disclosed devices to detect undesirable bending of the arm or wrist. However, the athlete will still have problems with his swing if he rotates or twists his arm.

OBJECTS AND SUMMARY OF THE INVENTION

Accordingly, a primary object of this invention is to provide a training device which may be used by an athlete to develop a proper swing for golf, tennis or other sports.

A further object of this invention is to provide a training device which provides a detectable signal when the arm is rotated about its longitudinal axis to assist the athlete in maintaining the proper arm position during the swing.

Another object of this invention is to provide a training device which provides a detectable signal when the arm has been bent improperly.

Yet another object of this invention is to provide a training device which provides a detectable signal when the arm has been bent to the desired position for a proper swing.

Still another object of the invention is to provide a training device which does not restrict the motion of the athlete's swing.

A more general object of this invention is to provide a training device which may be used on the left arm or the right arm, which may be used by numerous individuals independent of arm size, and which may be used during practice or actual play.

In summary, the golf training device of this invention includes a support body which is mountable to the arm of an athlete and a sensor assembly carried by the support body for sensing movement of the arm. The sensor assembly includes a pair of flexible strip layers having spaced first and second ends. The first ends of the strip layers are joined or laminated together. A displacement sensor is coupled to the second end of one of the strip layers, and is configured for detecting relative movement of the strip layers. An elevation sensor detects displacement of the strip layers from a predetermined elevation. The sensing assembly is configured for detecting displacement of the arm in two directions of movement with one direction of movement being rotation about the longitudinal axis of the arm and the other direction of movement being bending of the arm. A signal device is coupled to the sensor for producing a detectable signal when the sensor assembly detects movement of the arm in at least one of the two directions of movement.

Additional objects and features of the invention will be more readily apparent from the following detailed description and appended claims when taken in conjunction with the drawings.

DETAILED DESCRIPTION OF THE INVENTION

Reference will now be made in detail to the preferred embodiment of this invention, which is illustrated in the accompanying figures. Turning now to the drawings, wherein like components are designated by like reference numbers throughout the various figures, attention is directed to FIGS. 1–3.

Figure 1:
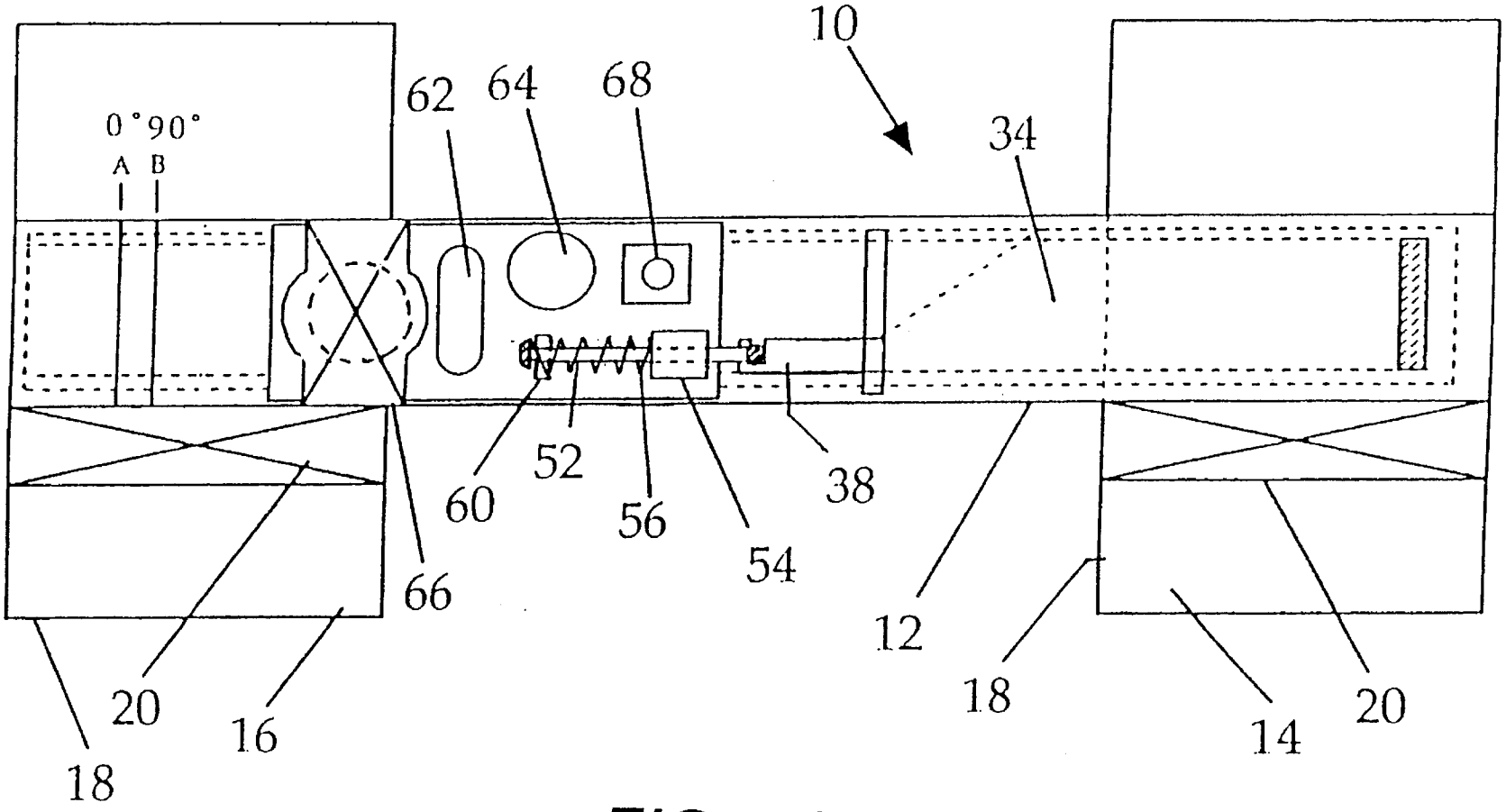
FIG. 1 is a top plan view of a golf training device in accordance with this invention.
Figure 2:
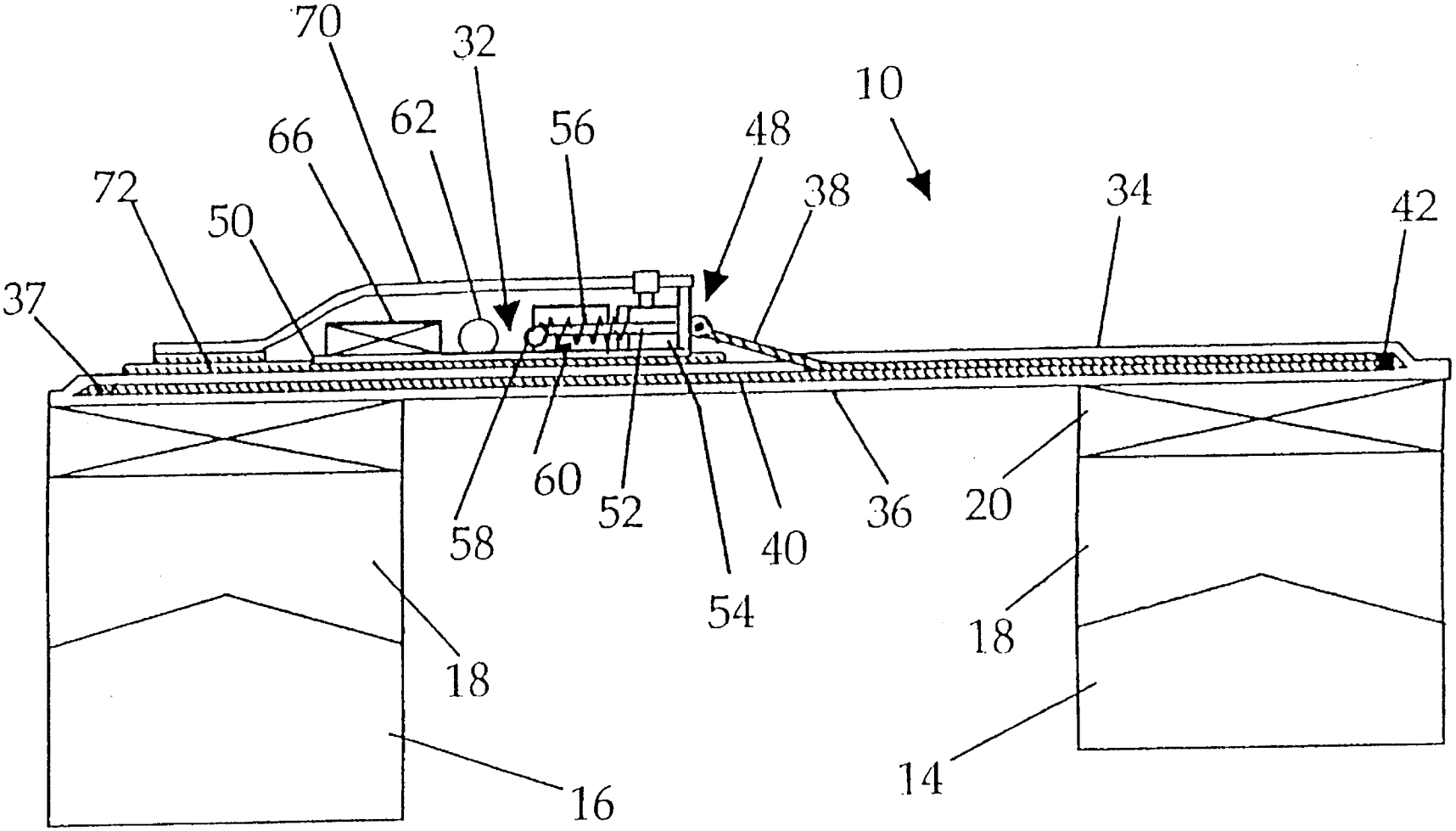
FIG. 2 is a sectional view taken substantially along line 2—2 in FIG. 1.

A training device 10 constructed in accordance with this invention for assisting an athlete in developing a proper swing generally includes a support body 12 which is mountable to the arm of an athlete. In the present embodiment, support body 12 includes a pair of spaced straps 14 and 16 which may be used to releasably secure the support body to the athlete's arm. Preferably, straps 14 and 16 are formed of an elastic material which resiliently expands and contracts to permit unrestricted-movement and flexing of the muscles in the arm. Straps 14 and 16 are preferably adjustable for use by several different individuals. As shown in FIGS. 1 and 2, straps 14 and 16 include a hook material 18 and a loop material 20 which cooperates with the hook material 18 to secure the ends of straps 14 and 16 together and retain support body 12 on the arm of an athlete. However, it is to be understood that the hook and loop materials 18 and 20 may be replaced with other known means for securing the ends of the straps together. Moreover, if desired straps 14 and 16 may be continuous, with the athlete inserting his hand through the straps and pulling the support body upwardly along his arm to the desired position.

Figure 3:
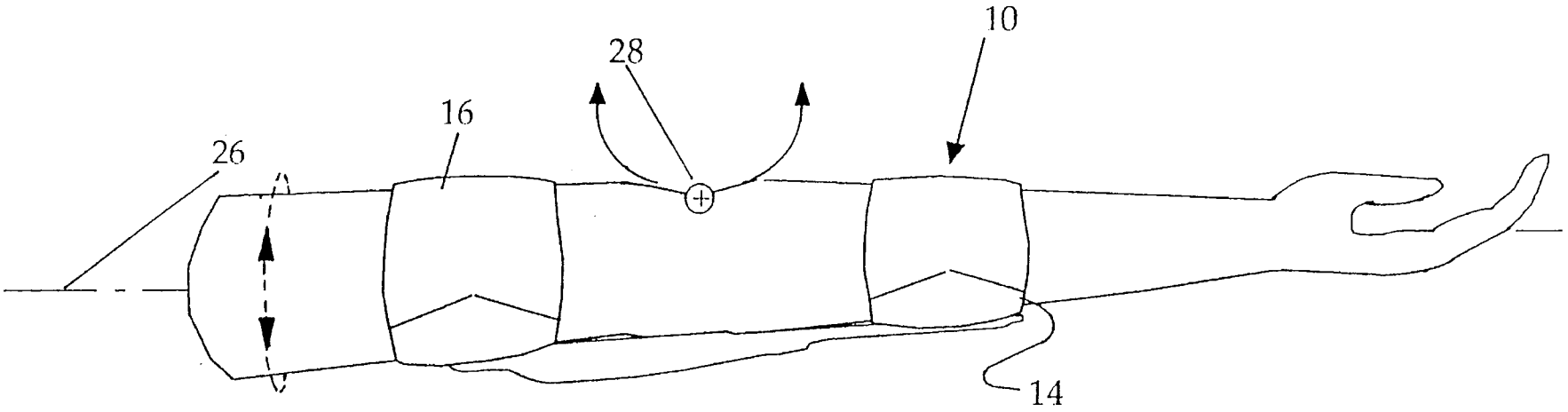
FIG. 3 is a schematic view of the golf training device of FIG. 1, shown mounted to an arm.

In this embodiment, training device 10 is adapted for monitoring movement of the athlete's arm in two directions of movement. One direction of movement is the rotational or pivotal movement of the arm about the longitudinal axis of the arm, generally designated at 26 in FIG. 3. The other direction of movement is the bending or pivoting of the arm about the axis of the elbow, generally designated at 28 in FIG. 3. Thus, training device 10 is preferably positioned with strips 14 and 16 located on opposite sides of the elbow as shown in FIG. 3. Maintaining the arm in the proper position relative to the axes 26 and 28 during the swing maximizes the power transmitted from the arm to the object of play, for example a golf ball, and ensures the arm is in the desired position at the point of contact. However, in other modifications of the invention the training device may be used to monitor other motions of the arm as for example rotation of the arm about axis 26 together with bending or pivoting of the wrist. The actual position of the training device 10 on the arm will depend upon the directions of motions monitored by the training device.

Turning particularly to FIGS. 1 and 2, training device 10 will be described in greater detail. A sensing assembly 32 is mounted to support body 12 for detecting movement of the support body and therefore the arm of the athlete. In the present embodiment, support body 12 includes first and second layers 34 and 36 having a pocket 37 defined therebetween. Layers 34 and 36 are preferably formed of a waterproof material, although other non waterproof materials may also be used. Sensing assembly 32 includes a pair of overlapping, flexible strips 38 and 40 extending longitudinally between layers 34 and 36 of the support body 12. In this embodiment, strips 38 and 40 are provided by separate members secured together at one end 42 with a suitable fastener as for example stitching, adhesive, heat staking, ultrasonic welding, etc. In other modifications, strips 38 and 40 may be formed of one piece of material. Strips 38 and 40 are preferably formed of a material which retains its flexibility after repeated deformation without bending or breaking. In this embodiment, strip 38 is formed of a plastic material while strip 40 is formed of a thin fiberglass material.

As is shown particularly in FIG. 2, the lower strip 40 extends the length of pocket 37 between the first and second layers 34 and 36. The upper strip 38 extends upwardly through the first layer 34 of the support body 12 and is coupled to a displacement sensor 48. The displacement sensor is configured to detect movement of the upper strip 38 relative to the lower strip 40. The displacement of the upper strip relative to the lower strip may be used to monitor movement of the athlete's arm. When the arm is bent about the axis 28 of the elbow, flexible strips 38 and 40 are simultaneously bent in an arc with the strips 38 and 40 traveling in slightly different paths. The difference in the linear component of movement of the strips 38 and 40 may be used to determine the degree of bending about the axis 28 of the elbow. As the strips 38 and 40 are rotated, the elevation of the upper strip 38 relative to the midpoint of a line drawn between the opposite ends of the strip 38 changes. Thus, the rotational movement of the arm about the longitudinal axis 26 may be observed by monitoring elevational changes of the strips 38 and 40.

Displacement sensor 48 generally includes a circuit board 50 mounted to the first layer 36 of support body 12. An actuator arm 52 is coupled to the end of upper strip 38 for detecting linear displacement of the strip 38 relative to lower strip 40. The actuator arm 52 extends through a support block 54 mounted to the circuit board 50. A spring 56 engages the support block 54 and the forward end of the actuator arm and urges the striker 58 of the actuator arm away from a contact 60 on the circuit board. The sensing assembly 32 further includes an elevation sensor 62 positioned in line with actuator arm 52 to detect any changes in elevation of the strips 38 and 40. A signal generator 64, such as a signal generating transducer, is mounted to circuit board 50 for generating a detectable signal when an electrical circuit is completed allowing a power source 66 (as for example a lithium type battery) to supply an electrical current to signal generator 64. A power switch 68 controls operation of sensing assembly 32, conserving power when training device 10 is not in use. A cover layer 70 covers and protects the electrical components of the sensing assembly 32. Preferably, the cover layer 70 is formed of a waterproof material and is releasably attached to the support body 12 by complementary hook and loop material layers 72.

In the present embodiment, training device 10 is used to provide a detectable signal when the athlete has moved his arm out of position. Alternatively, in other modifications of the invention, the training device may be used to provide a detectable signal when the arm is moved into the desired position by the athlete. If desired, in other modifications of the invention training device 10 may be provided with a mode selection switch which allows the athlete to select the first operational mode (providing a signal when the arm is moved out of position) or the second operational mode (providing a signal when the is moved into position).

Striker 58 engages contact 60 when the arm bent to the desired angle about the axis 28 of the elbow. In this embodiment, sensing assembly 32 is configured to provide an electrical current to signal generator 64 when the contact between striker 58 and contact 60 is broken, actuating signal generator 64 to generate a detectable signal. The sensing assembly 32 is further configured to actuate signal generator 64 when elevation sensor 62 senses that strips 38 and 40 have moved out of a predetermined elevation range. The signal generator 64 may be configured to produce an audio, visual or vibrational signal. In other modifications of the invention, where the training device 10 is adapted to inform the athlete that he has moved his arm to the desired position, sensing assembly 32 is configured to provide an electrical signal actuating signal generator 64 when striker 58 engages contact 60 and elevation sensor 62 senses movement of strips 38 and 40 to a predetermined elevation.

Figure 4C:
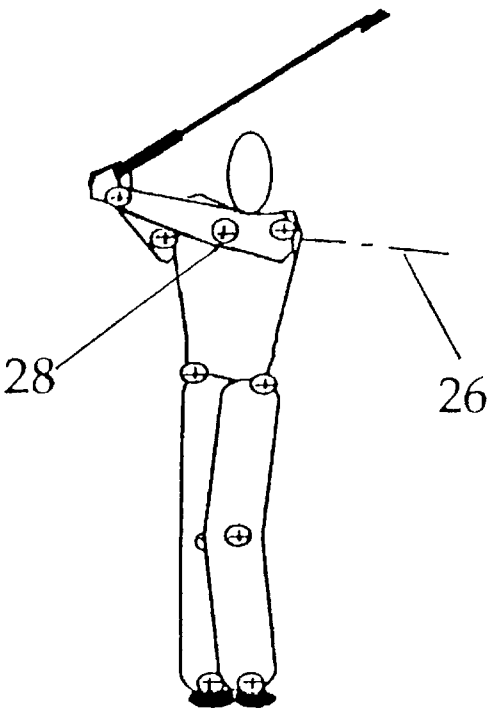
FIGS. 4A–4C are schematic views of the golf training device of FIG. 1, shown mounted to the left arm of an athlete at different stages during a proper golf swing.
Figure 4B:
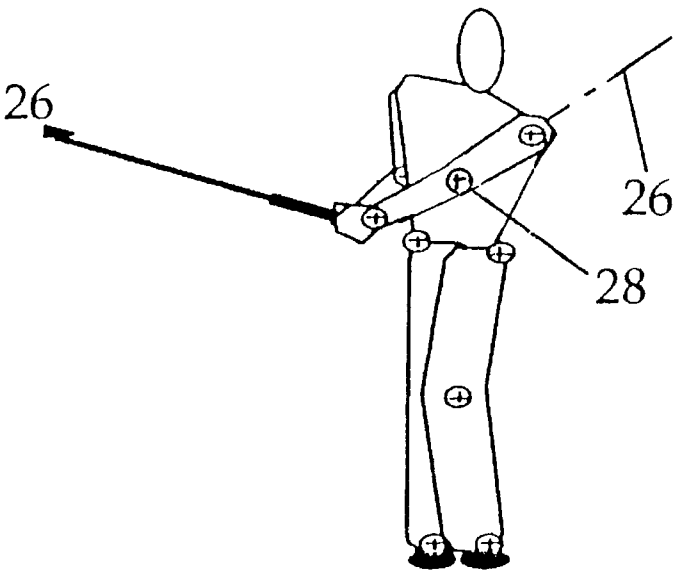
Figure 4A:
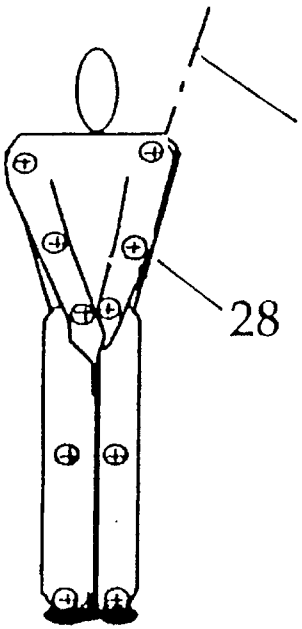
Figure 5C:
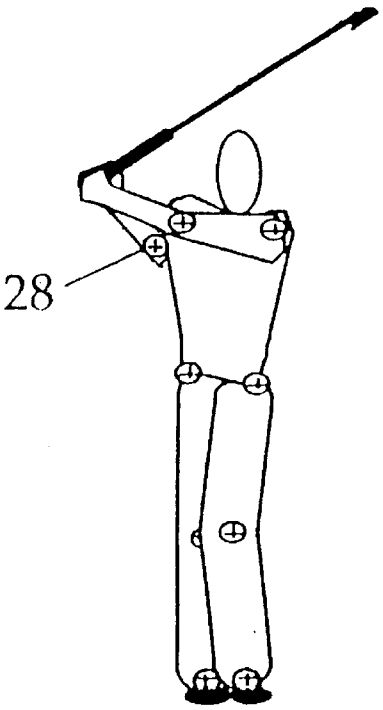
FIGS. 5A–5C are schematic views of the golf training device of FIG. 1, shown mounted to the right arm of an athlete at different stages during a proper golf swing.
Figure 5B:
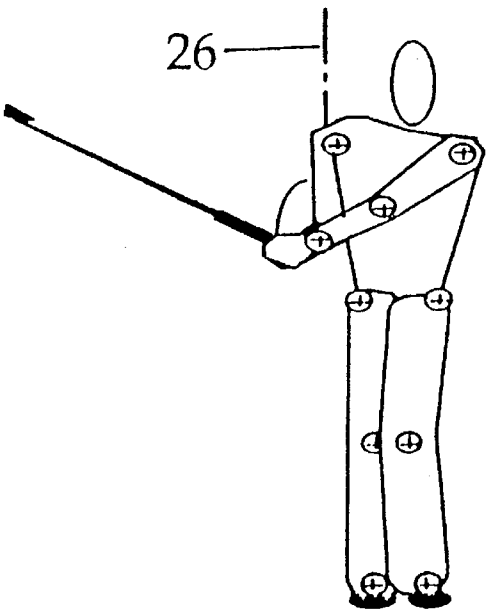
Figure 5A:
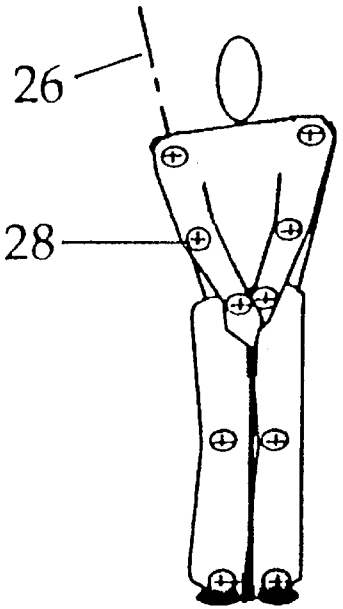

In this embodiment, training device 10 is configured to monitor the position of the lead arm of an athlete during the golf swing as shown in FIGS. 4A–4C. The lead arm is preferably bent approximately 5° about the elbow axis 28 and rotated approximately 5° from a straight position about the longitudinal axis 26 of the arm. The sensitivity of training device 10 is subject to considerable variation. In the present embodiment, sensing assembly detects bending of the arm about axis 28 beyond 5 ° and rotation of the arm about axis 26 beyond 5°. The training device may also be configured for monitoring the position of the other arm of the golfer as shown in FIGS. 5A–5C. The preferred position for the non-leading arm is with the arm bent approximately 5° about the elbow axis 28 at the beginning of the swing and 90° about the elbow axis 28 at the top of the backswing, and is rotated approximately 5° from a straight position about the longitudinal axis 26 of the arm.

Although this invention has been described in relation to a training device for improving a golf swing, it is to be understood that the training device 10 may be easily adapted for use in other sports including tennis, racquet ball and the like.

What is claimed is:

1. A training device mountable to an arm of an athlete for developing a proper arm swing, said arm including first and second arm portions, a first joint between said arm portions and a second joint spaced from said first joint, said training device comprising:

a support body mountable to said arm of said athlete, sensing means carried by said support body, said sensing means including a first sensor configured for detecting rotation of said arm relative to said second joint independent of the position of said first arm portion relative to said second arm portion and a second sensor configured for detecting movement of one of said arm portions relative to the other of said arm portions about said first joint, and signaling means coupled to said sensing means for producing a detectable signal when movement is detected by at least one of said first sensor and said second sensor.

2. The training device of claim 1 in which said support body includes a pair of spaced straps for mounting said support body to said arm.

3. The training device of claim 1 in which said sensing means includes overlapping first and second strip portions having spaced ends, said strip portions being joined together at one of said ends.

4. The training device of claim 3 in which said first sensor is an elevation sensor for detecting changes in elevation of said strip portions relative to a predetermined level to detect rotation of the arm relative to said second joint.

5. The training device of claim 3 in which said second joint includes a displacement sensor and in which the other of said ends of said first strip portion is coupled to said displacement sensor, said displacement sensor being configured for sensing movement of said first strip portion relative to said second strip portion to detect relative movement to said arm portions about said first joint.

6. The training device of claim 5 in which displacement sensor comprises an actuator arm coupled to said first strip portion and a contact member, said actuator arm engaging said contact member when said arm is bent to a predetermined position for a proper swing.

7. The training device of claim 3 in which said first and second strip portions comprise separate flexible strips laminated together at said one of said ends.

8. The training device of claim 1 in which said sensing means is configured for producing a detectable signal when said sensing means detects movement of said arm away from a predetermined position for a proper swing.

9. The training device of claim 1 in which said sensing means is configured for producing a detectable signal when said sensing means detects movement of said arm to a predetermined position for a proper swing.

10. The training device of claim 1 in which said sensing means is configured to actuate said signaling means when said arm is rotated more than five degrees about the longitudinal axis of said arm relative to a predetermined position for said proper swing.

11. The training device of claim 1 in which said sensing means is configured to actuate said signaling means when said arm is bent more than approximately five degrees relative to a predetermined position for said proper swing.

12. The training device of claim 1 in which said signaling means is a signal generating transducer.

13. A training device mountable to an arm of an athlete for developing a proper arm swing, said arm including a shoulder joint, an upper arm portion, an elbow joint and a lower arm portion, said training device comprising:

a support body mountable to said arm of said athlete, sensing means for sensing movement of said arm, said sensing means including a displacement sensor, an elevation sensor, and a pair of longitudinally extending flexible strip layers having spaced first and second ends, said first ends of said strip layers being joined together, said second end of one of said strip layers being movable relative to the other of said strip layers, said displacement sensor being coupled to said second end of said one of said strip layers and configured for detecting relative movement of said one of said strip layers relative to the other of said strip layers to detect movement of said lower arm portion relative to said upper arm portion about said elbow joint, said elevation sensor being configured for detecting movement of said strip layers relative to a predetermined elevation for detecting rotation of the combination of said upper arm portion and said lower arm portion relative to said shoulder joint, and signaling means coupled to said sensing means for producing a detectable signal when movement is detected by at least one of said displacement sensor and said elevation sensor.

14. The training device of claim 13 in which said sensing means is configured for producing a detectable signal when said sensing means detects movement of said arm away from a desired position for a proper swing.

15. The training device of claim 13 in which said sensing means is configured for producing a detectable signal when said sensing means detects movement of said arm to a desired position for a proper swing.

16. The training device of claim 13 in which said sensing means is configured to actuate said signaling means when said arm is rotated more than five degrees about the longitudinal axis of said arm relative to a predetermined position for said proper swing.

17. The training device of claim 13 in which said sensing means is configured to actuate said signaling means when said arm is bent more than approximately five degrees relative to a predetermined position for said proper swing.

18. The training device of claim 13 in which said signaling means produces an audio signal when said at least one of said first sensor and said second sensor detects movement of said arm.

* * * * *